US008550881B2

(12) United States Patent
Loutzenheiser et al.

(10) Patent No.: US 8,550,881 B2
(45) Date of Patent: Oct. 8, 2013

(54) VANE, MOUNTING ASSEMBLY AND THROWING WHEEL APPARATUS HAVING A LOCKING MEMBER TAPERED IN TWO PLANES

(75) Inventors: Mathew Lynn Loutzenheiser, LaGrange, GA (US); Phillip Dewayne Harrington, LaGrange, GA (US)

(73) Assignee: Pangborn Corporation, Fairburn, GA (US)

( * ) Notice: Subject to any disclaimer, the term of this patent is extended or adjusted under 35 U.S.C. 154(b) by 359 days.

(21) Appl. No.: 12/619,452

(22) Filed: Nov. 16, 2009

(65) Prior Publication Data

US 2011/0117824 A1 May 19, 2011

(51) Int. Cl.
*B24C 5/06* (2006.01)
*B24C 3/24* (2006.01)

(52) U.S. Cl.
USPC ..... 451/98; 451/95

(58) Field of Classification Search
USPC ..... 451/98, 97, 94, 95, 96
See application file for complete search history.

(56) References Cited

U.S. PATENT DOCUMENTS

| | | | |
|---|---|---|---|
| 700,224 | A | 5/1902 | McRae |
| 1,286,865 | A | 12/1918 | Winegardner |
| 2,590,576 | A | 3/1952 | Rosenberger |
| 2,819,562 | A | 1/1958 | Barnes |
| 3,197,920 | A | 8/1965 | Moore |
| 3,241,266 | A | 3/1966 | Bowling, Jr. |
| 3,287,858 | A | 11/1966 | Moore |
| 3,368,308 | A | 2/1968 | Physioc |
| 3,513,597 | A | 5/1970 | Groot |
| 3,694,963 | A | 10/1972 | Leliaert |
| 3,745,711 | A | 7/1973 | Haberlin |
| 3,768,209 | A | 10/1973 | Punter |
| 3,785,105 | A | 1/1974 | Freeman |

(Continued)

FOREIGN PATENT DOCUMENTS

| | | | |
|---|---|---|---|
| CN | 2616341 | Y | 5/2004 |
| EP | 162584 | A3 | 8/1986 |

(Continued)

OTHER PUBLICATIONS

International Search Report and Written Opinion dated Mar. 1, 2010, directed to counterpart PCT/US2009/069271 application. (9 pages).

(Continued)

*Primary Examiner* — Robert Rose
(74) *Attorney, Agent, or Firm* — Venable LLP; Jeffri A. Kaminski

(57) ABSTRACT

A vane of a throwing wheel apparatus including a particle throwing portion, extending between first and second ends, having a first throwing face, a second throwing face, and two side edges. Each of the side edges extend substantially parallel to one another and includes a locking member adapted to be detachably coupled to a mounting element of the throwing wheel apparatus. Each locking member includes a first taper in a first plane and a second taper in a second plane. The first plane is substantially perpendicular to each side edge of the vane and the second plane is substantially parallel to the first taper. The side edges define a width smaller than a predetermined distance between first and second mounting elements of the throwing wheel apparatus so that when coupled to the mounting elements a gap is present on both sides of the vane.

11 Claims, 7 Drawing Sheets

(56) References Cited

U.S. PATENT DOCUMENTS

| | | | | |
|---|---|---|---|---|
| 3,867,791 | A | 2/1975 | Goff | |
| 3,872,624 | A | 3/1975 | Ramaswamy | |
| 3,897,014 | A | 7/1975 | Luthi | |
| 3,945,150 | A | 3/1976 | Beckner | |
| 4,034,516 | A | 7/1977 | Maeda | |
| 4,069,025 | A | 1/1978 | Macmillan | |
| 4,164,104 | A | 8/1979 | Carpenter | |
| 4,174,814 | A | 11/1979 | Warren | |
| 4,176,502 | A | 12/1979 | Leliaert | |
| 4,207,712 | A | 6/1980 | Toedtli | |
| 4,249,350 | A | 2/1981 | Goff | |
| 4,329,819 | A | 5/1982 | May | |
| 4,395,851 | A | 8/1983 | Watts | |
| 4,447,993 | A * | 5/1984 | Laido | 451/97 |
| 4,480,413 | A | 11/1984 | Schulte et al. | |
| 4,509,300 | A | 4/1985 | Carpenter | |
| 4,627,197 | A | 12/1986 | Klee | |
| 4,646,483 | A | 3/1987 | Mangan | |
| 4,649,673 | A | 3/1987 | Van Huyssteen | |
| 4,680,899 | A | 7/1987 | Carpenter | |
| 4,723,379 | A | 2/1988 | MacMillan | |
| 4,739,937 | A | 4/1988 | Carpenter | |
| 4,941,295 | A | 7/1990 | Carpenter | |
| 4,941,297 | A | 7/1990 | Carpenter | |
| 5,081,801 | A | 1/1992 | Fylak | |
| 5,291,696 | A | 3/1994 | Enegren | |
| 5,476,412 | A | 12/1995 | Stoltz | |
| 5,688,162 | A | 11/1997 | Williams | |
| 5,759,091 | A | 6/1998 | MacMillan | |
| 5,888,125 | A * | 3/1999 | Kuehn | 451/97 |
| 5,921,484 | A | 7/1999 | Smith | |
| 5,975,985 | A | 11/1999 | Sutherland | |
| 6,126,516 | A | 10/2000 | Barrier | |
| 6,447,378 | B1 | 9/2002 | Hoff | |
| 6,719,229 | B2 | 4/2004 | Aihara | |
| 6,764,390 | B2 | 7/2004 | Holloway | |
| 6,949,014 | B2 | 9/2005 | Barrier et al. | |
| 6,981,910 | B1 | 1/2006 | Goff | |
| 7,311,584 | B2 | 12/2007 | Goff | |
| 7,585,207 | B2 | 9/2009 | Barriger | |
| 2008/0076333 | A1 | 3/2008 | Krause | |

FOREIGN PATENT DOCUMENTS

| | | | |
|---|---|---|---|
| EP | 1930122 | A1 | 6/2008 |
| FR | 2663579 | | 12/1991 |
| GB | 449253 | A | 6/1936 |
| GB | 464608 | A | 4/1937 |
| GB | 510681 | A | 8/1939 |
| GB | 527619 | A | 10/1940 |
| GB | 532480 | A | 1/1941 |
| GB | 533051 | | 2/1941 |
| GB | 545650 | A | 6/1942 |
| GB | 654420 | A | 6/1951 |
| GB | 729012 | A | 4/1955 |
| GB | 750432 | | 6/1956 |
| GB | 821869 | A | 10/1959 |
| GB | 830042 | A | 3/1960 |
| GB | 912241 | A | 12/1962 |
| GB | 912242 | A | 12/1962 |
| GB | 1003441 | | 9/1965 |
| GB | 1041459 | A | 9/1966 |
| GB | 1114403 | A | 5/1968 |
| GB | 2160131 | | 12/1985 |
| JP | 59047163 | A | 3/1984 |
| WO | WO-0012265 | A1 | 3/2000 |
| WO | WO-02068153 | A1 | 9/2002 |

OTHER PUBLICATIONS

Chinese Official Action dated May 6, 2013 in Chinese Application No. 200980155298.0 (and translation of action).

* cited by examiner

VANE, MOUNTING ASSEMBLY AND THROWING WHEEL APPARATUS HAVING A LOCKING MEMBER TAPERED IN TWO PLANES

BACKGROUND

The present invention relates generally to new and useful improvements in a rotatable abrading device of the type commonly referred to as centrifugal blasting machines, and more particularly to the throwing wheels and blade assemblies that are used in such machines.

Abrasive blasting machines having a wheel or rotor assembly provided with a plurality of abrasive throwing blades or vanes arranged radially about the face of the rotor are well known. In use, a stream of abrasive particulate material is fed into the path of the rotating wheel from an impeller secured to the rotor. The blades are adapted to receive and throw the abrasive from the periphery of the rotor at an appropriate discharge point in the machine casing at a blasting velocity to strip or clean metal castings or the like.

The throwing vanes due to the nature of their use are subject to excessive wear and are, therefore, removably mounted on a runnerhead portion of the wheel assembly for replacement as needed. There are two basic styles of runnerhead assemblies, a single-sided runnerhead and double-sided runnerhead. The use of a single-sided runnerhead is advantageous to reduce the "overhung load" on the shaft of the motor or spindle. On the other hand, the double-sided runnerhead may protect the internal liners on the front of the wheel housing. Many different methods of fixing the blades to a runnerhead assembly have been employed.

One inherent problem with either the single-sided or the double-sided runnerhead is the possibility of a blade "shot-locking" in the runnerhead. Shot-locking occurs when abrasive and dust wedge in between the blade and the runnerhead. Maintenance is required to hammer the vanes out of the runnerhead. This maintenance results in a loss of valuable operating time. Furthermore, while the blades must be removable, they must also be held securely so that they resist the tremendous centrifugal forces exerted on them when the wheel is operating.

In short, there exists a need in the art for an improved blade and runnerhead locking assembly for securing the blades to the wheel of a centrifugal blasting machine. The improved blades should be easily removed and replaced without the need for special tools or extensive disassembly of the device. The blades should not be susceptible to shot locking or jamming in position due to fine particulate fouling the mounting mechanism.

SUMMARY

In an embodiment, a vane of a throwing wheel apparatus, includes a first end, a second end, and a particle throwing portion extending between the first and second ends. The particle throwing portion includes a first throwing face, a second throwing face, and two side edges. Each of the side edges may extend substantially parallel to one another and include a locking member adapted to be detachably coupled to a mounting element of the throwing wheel apparatus. Each locking member may include a first taper in a first plane and a second taper in a second plane. The first plane may be substantially perpendicular to each side edge of the vane and the second plane may be substantially parallel to the first taper. The side edges may define a width smaller than a predetermined distance between first and second mounting elements of the throwing wheel apparatus so that when the vane is coupled to the mounting elements a gap is present on both sides of the vane.

According to one exemplary embodiment, a mounting assembly of a throwing wheel apparatus includes a first mounting element and a second mounting element. The first and second mounting elements may be substantially parallel to one another and spaced apart from one another along a central axis of rotation. Each of the first and second mounting elements may define a mounting face having a central bore and a plurality of radially extending mounting recesses. Each mounting recess may detachably receive a locking member of a vane and is tapered in two planes.

According to a further exemplary embodiment, a throwing wheel apparatus includes a vane having a first end, a second end, and a particle throwing portion extending between the first and second ends. The particle throwing portion includes a first throwing face, a second throwing face, and two side edges. Each of the side edges may extend substantially parallel to one another and may include a locking member adapted to be detachably coupled to a mounting element of the throwing wheel apparatus. Each locking member may include a first taper in a first plane and a second taper in a second plane. The first plane may be substantially perpendicular to each side edge of the vane and the second plane may be substantially parallel to the first taper. The throwing wheel apparatus further may include a mounting assembly having a first mounting element and a second mounting element. The first and second mounting elements may be arranged substantially parallel to one another and may be spaced apart from one another along a central axis of rotation. Each of the first and second mounting elements may define a mounting face having a central bore and a plurality of radially extending mounting recesses. Each mounting recess may be adapted to detachably receive a locking member of the vane. Each mounting recess may be tapered in two mounting planes corresponding to the first and second planes of the locking portion of the vane. The side edges of the vane may define a width smaller than a predetermined distance between the first and second mounting elements of the mounting assembly so that when the vane is coupled to the mounting elements a gap may be present on both sides of the vane.

This summary is provided merely to introduce certain concepts and not to identify any key or essential features of the claimed subject matter. Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of embodiments of the invention, as illustrated in the accompanying drawings wherein like reference numbers generally indicate identical, functionally similar, and/or structurally similar elements. Unless otherwise indicated, the accompanying drawing figures are not to scale.

DETAILED DESCRIPTION

Various embodiments of the invention are discussed herein. While specific embodiments are discussed, specific terminology is employed for the sake of clarity. However, the invention is not intended to be limited to the specific terminology so selected and it should be understood that this is done for illustration purposes only. A person skilled in the relevant art will recognize that other components and configurations can be used without parting from the spirit and scope of the invention. Each specific element includes all technical equivalents that operate in a similar manner to accomplish a similar purpose.

Figure 1:
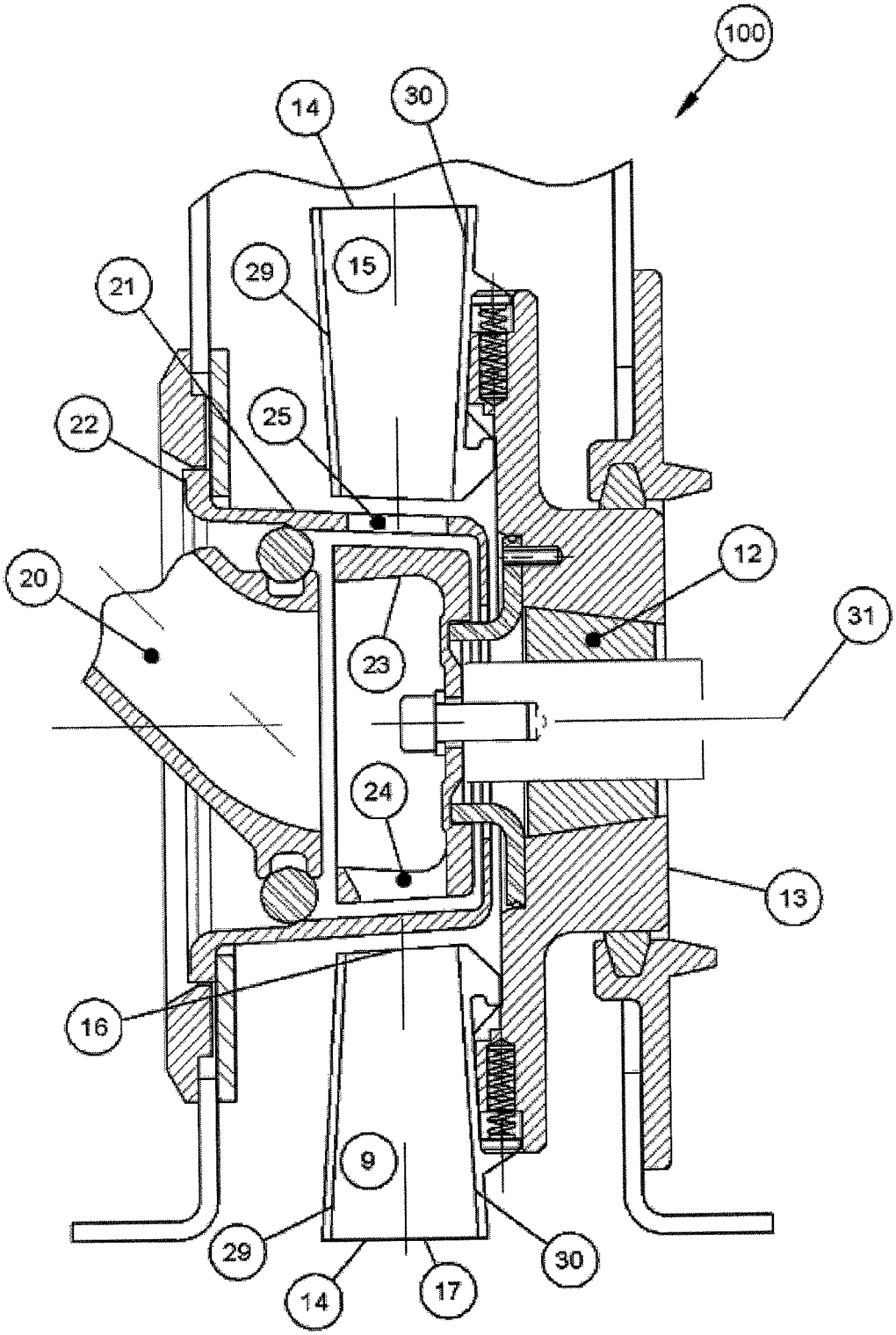
FIG. 1 depicts a partial sectional view of a centrifugal blasting machine according to the prior art.

Referring now to the drawings, there is shown in FIG. 1 a throwing wheel assembly 100 of an abrasive blasting machine having a single-sided runnerhead assembly, according to the prior art. Throwing wheel 100 may include a central hub or rotor 12 to which may be affixed a runnerhead 13 having a common axis of rotation 31 therewith. A plurality of throwing blades 14 (also referred to as blades or vanes) may be perpendicularly mounted on the face of runnerhead 13 and may extend substantially radially from the axis of rotation 31 of rotor 12. An innermost inlet end 16 of each throwing blade 14 may be spaced a distance from the axis of rotation 31 for receiving particulate abrasive material from an impeller 23. Impeller 23 may be disposed on the hub 12 between the inlet ends 16 of throwing blades 14 for feeding the abrasive particles which are received from a fixed spout 20 to throwing blades 14 in a usual manner. Each throwing blade 14 may have two side edges 30, 29, a front throwing face 15 and a rear throwing face 9, an inlet end 16 and an outlet end 17. The impeller case 21 may comprise an open-ended flange 22 connected to the machine casing and open to the spout 20. An impeller 23 may be disposed within case 21 and is rotatably affixed to hub 12. Impeller 23 may be provided with openings 24 for discharging abrasive received from spout 20 outwardly of case 21 through a discharge opening 25 therein upon rotation of wheel 100. In this manner abrasives may be fed to the inlet ends 16 of throwing blades 14 as the throwing blades 14 rotate past the opening 25. The abrasive may then be moved along the front throwing face 15 of the blade from the inlet end 16 to the outlet end 17 for discharge therefrom at a selected blasting velocity.

This description is of the preferred embodiment of a throwing wheel assembly. It is to be understood that the structure thus far described refers to conventional structure as found in known blasting wheel devices and that embodiments of the present invention, which are to be hereinafter described in further detail, is not limited to the particular device shown. The invention may work equally well in any throwing wheel. The drawings have been simplified to show only such conventional parts of wheel assembly 100 as are necessary for a clear understanding of the present invention.

Figure 2:
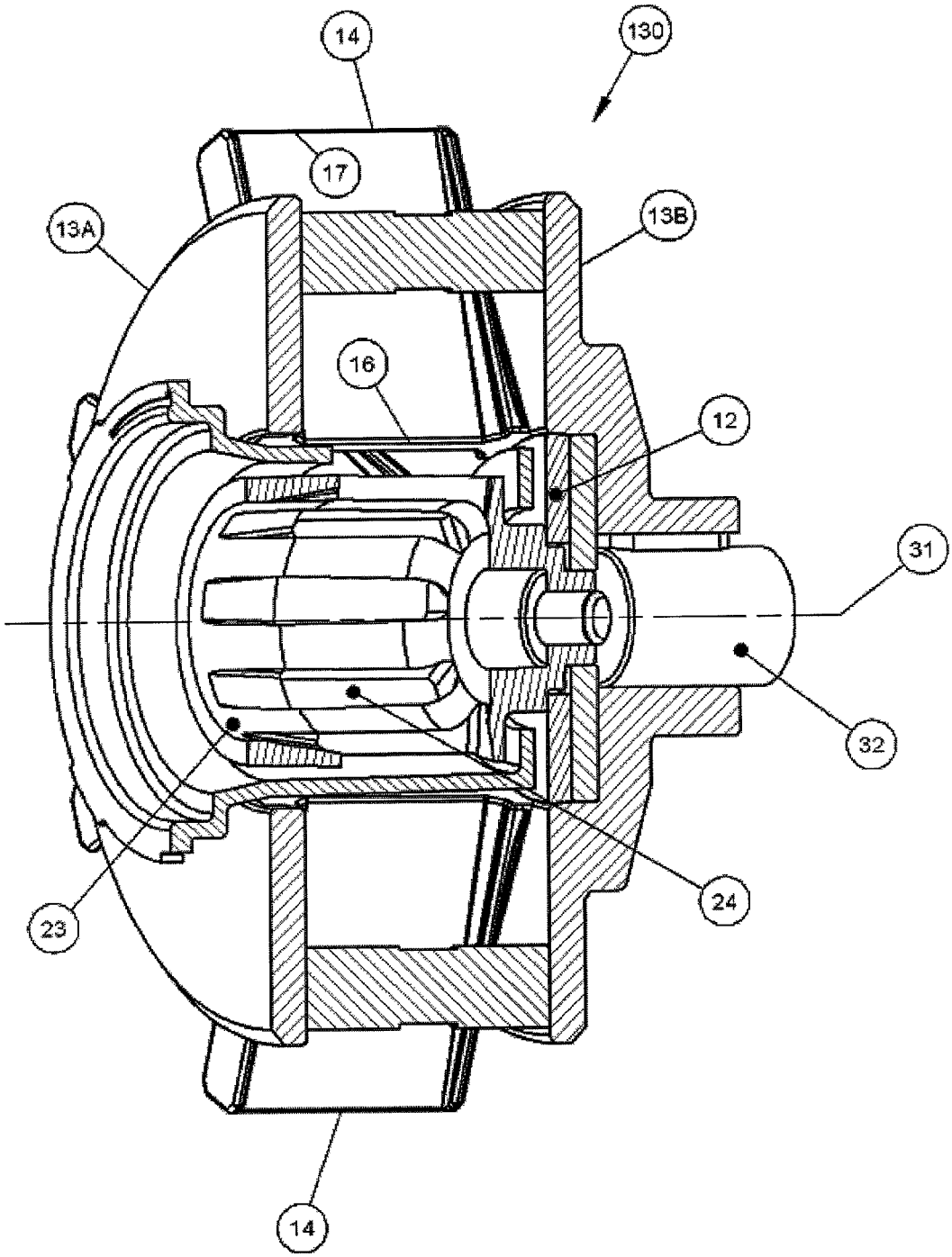
FIG. 2 depicts a perspective cross-sectional view of a double-sided runnerhead assembly according to an exemplary embodiment of the present invention.

FIG. 2 depicts a perspective cross-sectional view of a double-sided runnerhead assembly 130, according to an exemplary embodiment of the present invention. The runnerhead assembly 130 may include a first runnerhead 13A, or first mounting element, and a second runnerhead 13B, or second mounting element. The runnerheads 13A, 13B may be arranged substantially parallel to one another and may be spaced apart from one another along a central axis of rotation 31. A plurality of throwing blades 14 may be mounted substantially perpendicular to the inner faces of runnerheads 13A and 13B and may extend substantially radially from the axis of rotation 31 of rotor 12. An innermost inlet end 16 of each throwing blade 14 may be spaced a distance from the axis of rotation 31 to receive particulate abrasive material from an impeller 23. The use of a double-sided runnerhead may be advantageous to reduce the "overhung load" on the shaft of the motor or spindle 32.

Figure 3:
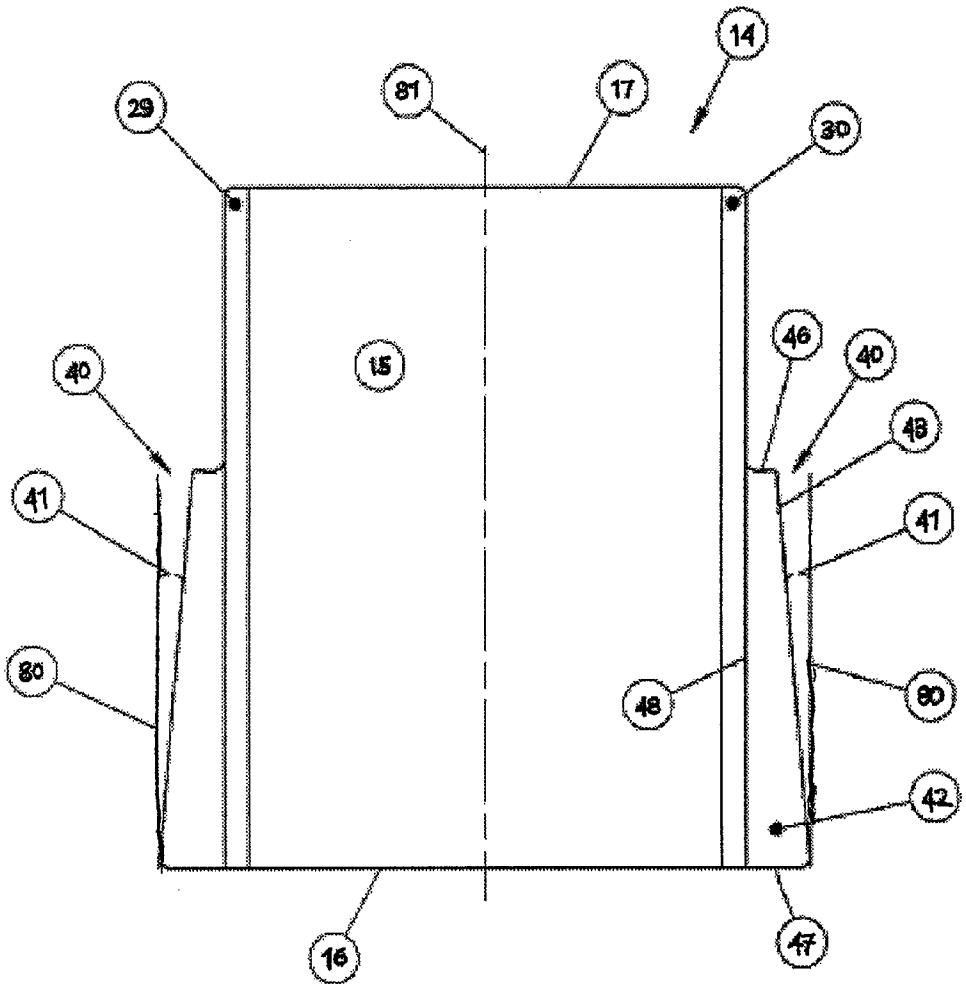
FIG. 3 depicts a front view of a throwing blade with two locking elements, according to an exemplary embodiment of the present invention.
Figure 4:
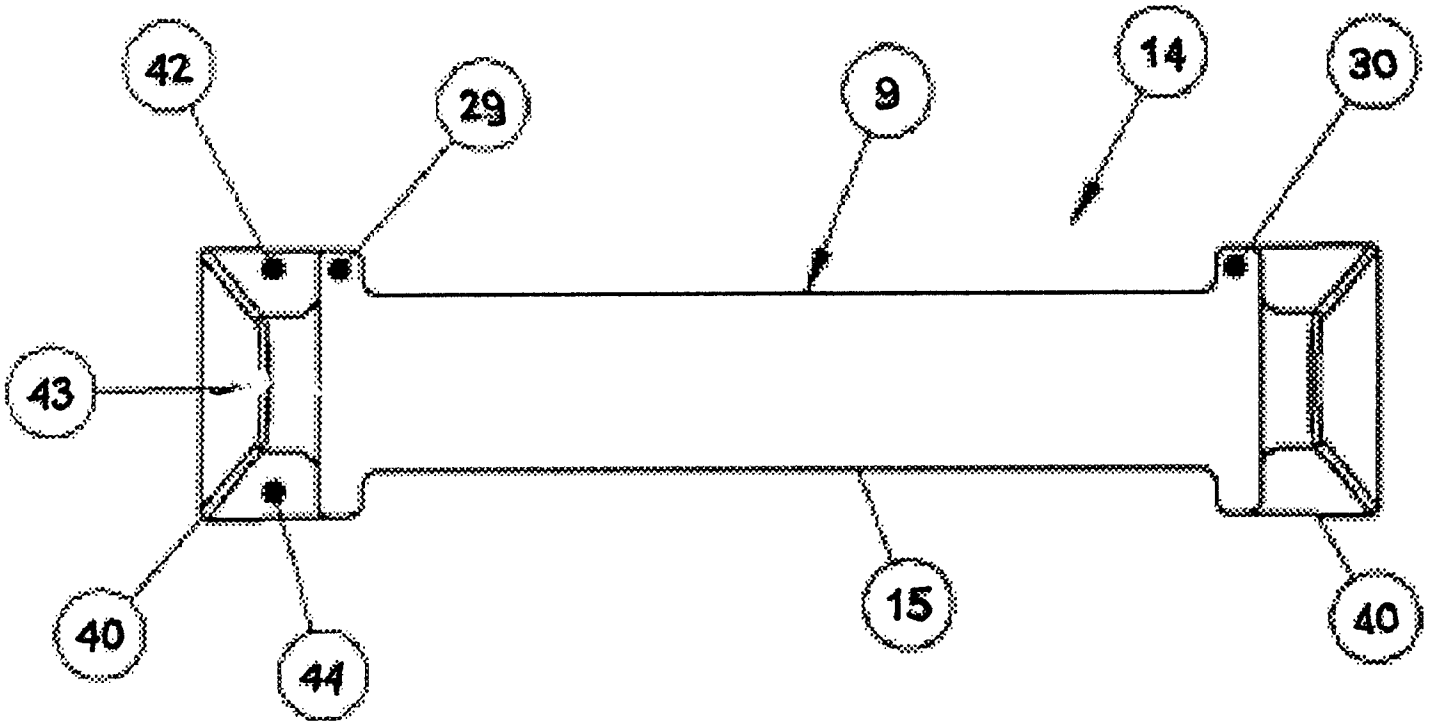
FIG. 4 depicts a top view of the throwing blade with two locking elements of FIG. 3.
Figure 5:
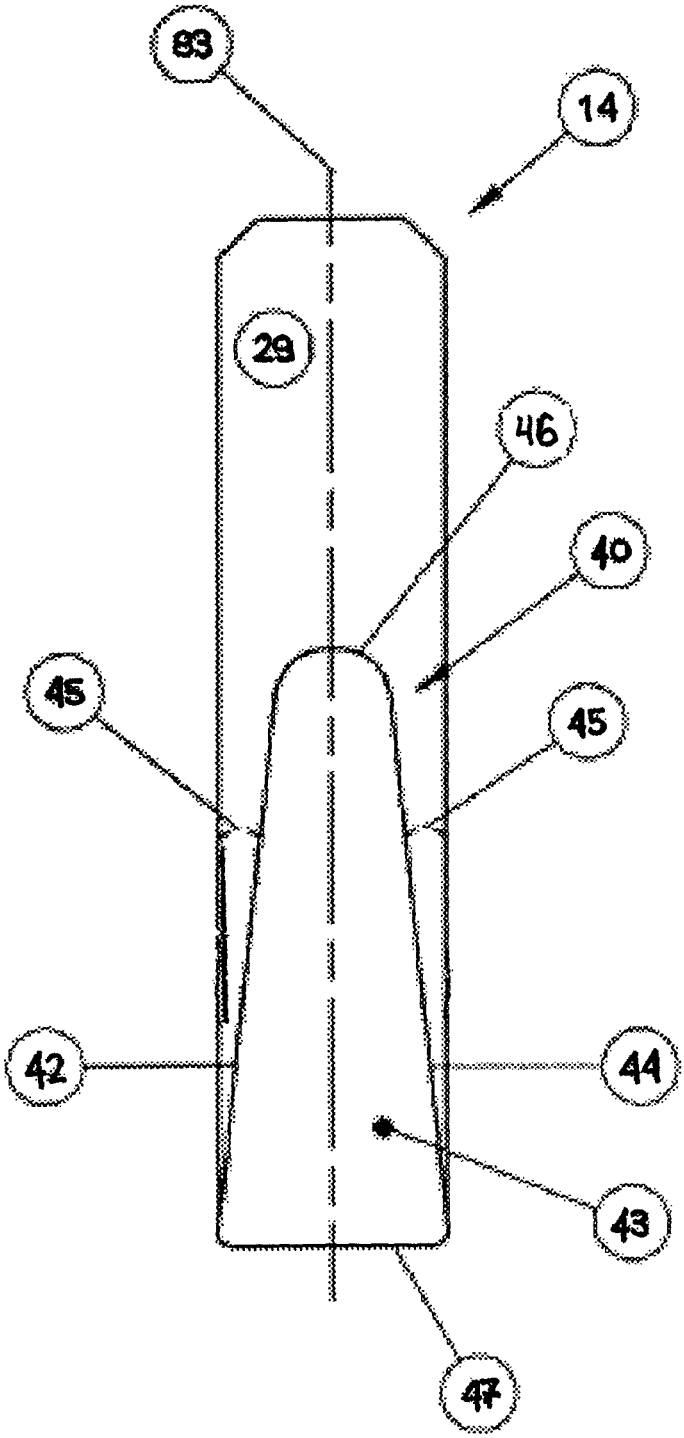
FIG. 5 depicts a side view of the throwing blade with two locking elements of FIG. 3.

In one embodiment, a throwing blade 14 of novel configuration may be provided for quick and easy removal from the runnerhead assembly 130 in the most efficient way possible with a minimum of complex removable parts. Referring to FIGS. 3-5, there is shown in greater detail the throwing blades 14 according to embodiments of the present invention.

FIG. 3 depicts a front elevational view of a throwing blade 14 with two locking members 40, according to an exemplary embodiment of the present invention. The throwing blade 14 includes an inlet end 16, an outlet end 17, and a particle throwing portion extending between the inlet and outlet ends 16, 17. The particle throwing portion includes a front throwing face 15, a rear throwing face 9 (see FIG. 4) and two side edges 29, 30. Each of the side edges 29, 30 may extend substantially parallel to one another between the inlet end 16 and the outlet end 17 on opposite sides at the vane. Each side edge 29, 30 may include a locking member 40 that may be detachably coupled to a mounting element 50 (see FIG. 6) of a runnerhead 13A, B at connection 48. Each locking member 40 may include a top end 46, a bottom end 47, a front surface 43, and two front-side surfaces 42, 44 (see FIG. 5). The front surface 43 is arranged between the top end 46 and the bottom end 47 and extends at an angle towards the axis of rotation 31 (See FIG. 1) opposite the connection 48 between the locking member 40 and the throwing face 9. The front-side surfaces 42, 44 are also each arranged between the top end 46 and the bottom end 47. The front-side surfaces 42, 44 are each further positioned between the front surface 43 and the connection 48 between the locking member 40 and the throwing face 9.

Each locking member 40 may be tapered at an angle 41 in a first plane 80. The first plane 80 may be substantially parallel to each side edge of the vane 29, 30 and/or the central axis 81 of the throwing blade 14. Stated differently, the front surface 43 may be tapered from the bottom end 47 to the top end 46 in a direction substantially perpendicular to the connection 48 between the locking member 40 and the side edges 29, 30 of the throwing blade 14. In one embodiment, the front surface 43 may be tapered along the entire length of the locking member 40. According to another embodiment, the front surface 43 may be tapered at an angle between approximately three- to seven-degrees. Further, the locking member 40 may either be made from the same or different material as the vane 14.

FIG. 4 depicts a top view of the throwing blade 14 with two locking members 40 of FIG. 3. Each side edge 29, 30, as shown in FIG. 3, may be a flange coupled to each side of the front and rear throwing faces 15, 9. In an exemplary embodiment, the locking members 40 may protrude out from the side edges 29, 30 of the throwing blade 14 at connection 48 towards the mounting element. According to one embodiment, the locking members 40 are positioned along the side edges 29, 30 near the inlet end 16 of the throwing blade 14. However, other positions for the locking members 40 may alternatively be used.

FIG. 5 depicts a side view of the throwing blade 14 with two locking members 40 of FIG. 3. As shown in FIG. 5, each locking member 40 located on side edges 29, may be tapered at an angle 45. Stated differently, each front-side surface 42, 44 may be tapered from the bottom end 47 to the top end 46 in a direction towards a center axis 83 of the locking member 40 and/or side edge 29, 30 of the throwing blade 14. In one embodiment, the top edge 46 may be rounded or arched. In another embodiment, each front-side surface 42, 44 may be tapered along the entire length of locking member 40. However, in some embodiments the front-side surface 42, 44 may not touch along the entire surface of the mounting recess. In a further embodiment, the front-side surfaces 42, 44 may be tapered at an angle 45 between approximately three- and seven-degrees.

Figure 6:
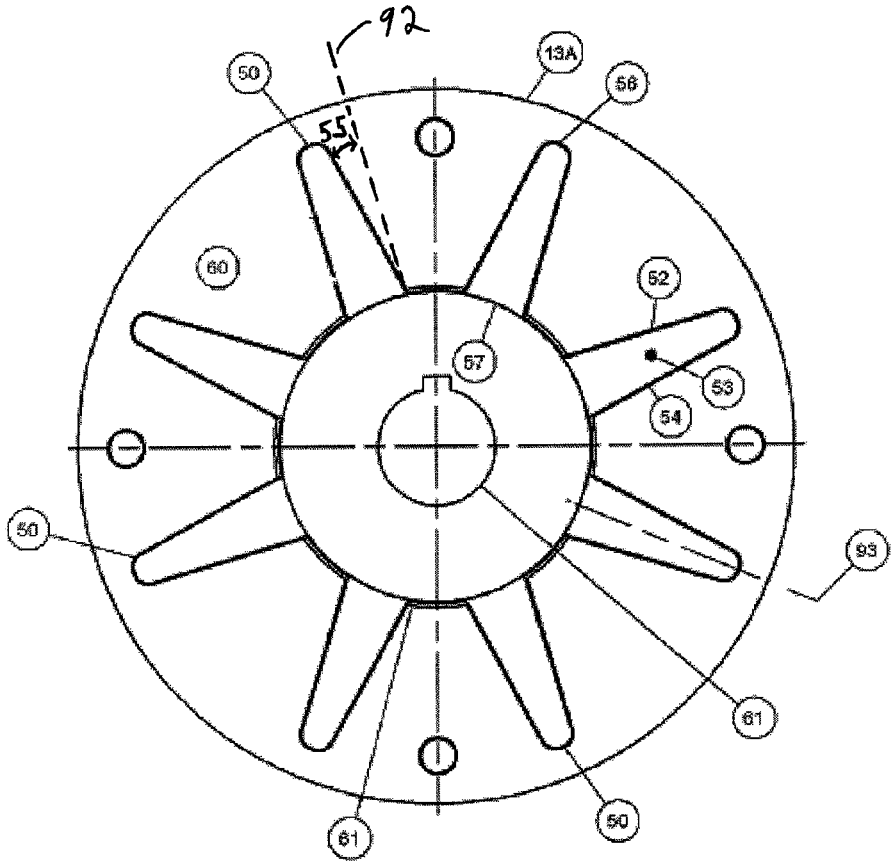
FIG. 6 depicts a side view of a runnerhead with mounting recesses according to an exemplary embodiment of the present invention.

FIG. 6 depicts a side view of a runnerhead 13A with mounting recesses 50 according to an exemplary embodiment of the present invention. The runnerhead 13A, or mounting element, may define a mounting face 60 having a central bore 61 and a plurality of radially extending mounting recesses 50. Each mounting recess 50 may be adapted to detachably receive a locking member 40 of a throwing blade 14. Each mounting recess may include a first end 56, a second end 57, a bottom recessed portion 53 and two bottom-side recessed portions 52, 54. In one embodiment, the mounting recesses 50 may be positioned on the mounting face 60 radially at a distance from the central bore 61.

In an exemplary embodiment, each mounting recess 50 may be tapered at a first angle in a first plane and at a second angle 55 in a second plane 92 that is perpendicular to the first plane. The first plane may correspond to the first plane 80 of the locking member 40 coupled to the throwing blade 14. Specifically, the bottom recessed portion 53 may be tapered at an angle from the second end 57 to the first end 56 along the axis of rotation 31 (see FIG. 1), so that the bottom recessed portion 53 is recessed deeper into the mounting face at the second end 57 than at the first end 56. Further, the bottom-side recessed portions 52, 54 may be tapered at an angle 55 from the second end 57 to the first end 56 in a direction towards a center axis 93 of the mounting recess 50. Alternatively stated, the first plane may be substantially parallel to the axis of rotation and the second plane 92 may be substantially perpendicular to the first plane.

Figure 7:
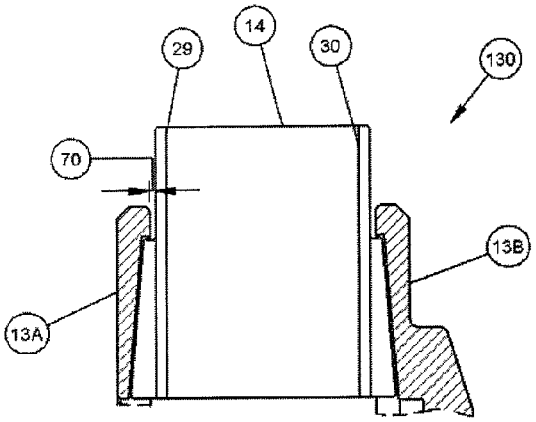
FIG. 7 depicts a front view of the throwing blades locked into the mounting recesses of the runnerhead, according to an exemplary embodiment of the present invention.

FIG. 7 depicts a perspective view of the throwing blades 14 locked into the mounting recesses 50 of the runnerhead, according to an exemplary embodiment of the present invention. In one embodiment, the side edges 29, 30 of the throwing blade 14 may define a width smaller than a pre-determined distance between the first and second runnerheads 13A, 13B, or mounting elements, of the mounting assembly 130 so that when coupled to the runnerheads 13A, 13B a gap 70 may be present on both sides of the vane. The gap 70 may be sized such that the largest abrasive used by the throwing wheel assembly 100 cannot become lodged in the gap.

Figure 8:
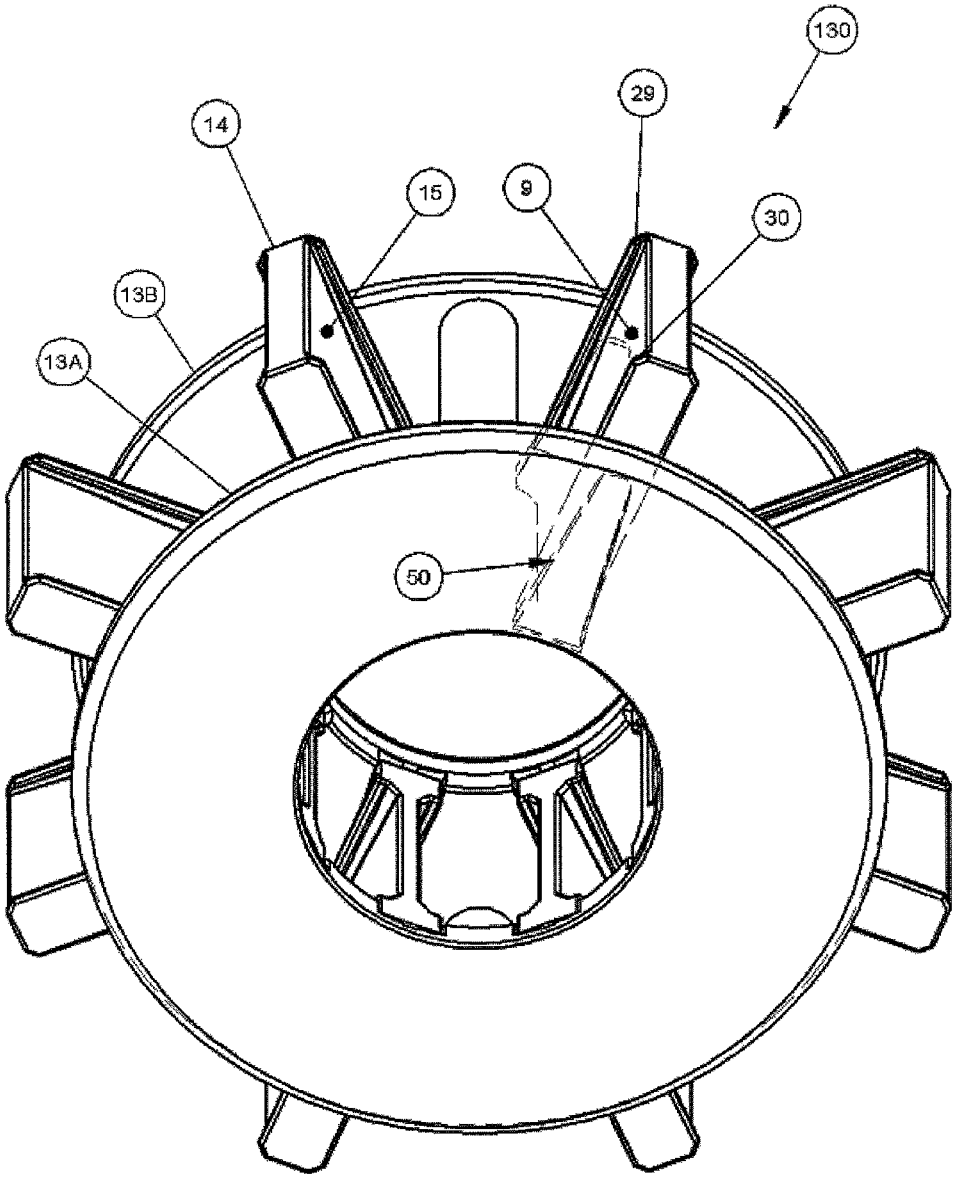
FIG. 8 depicts a front perspective view of the throwing blades locked into the mounting recesses of the runnerhead, according to an exemplary embodiment of the present invention.

FIG. 8 depicts an alternative front perspective view of the throwing blades 14 locked into the mounting recesses 50 of the runnerhead 13A, 13B according to an exemplary embodiment of the present invention.

It will be understood that the above description of the present invention is susceptible to various modifications, changes and adaptations, and that the same are intended to be comprehended within the meaning and range of equivalents of the appended claims.

What is claimed is:

1. A vane of a throwing wheel apparatus, comprising:

a first end;

a second end; and a particle throwing portion extending between the first and second ends and including a first throwing face, a second throwing face, and two side edges, wherein each of the side edges extend substantially parallel to one another and includes a locking member adapted to be detachably coupled to a mounting element of the throwing wheel apparatus, wherein each locking member includes a first surface extending from the first end towards the second end, the first surface being tapered along a first direction at a first angle and a second surface extending from the first end towards the second end, the second surface being tapered along the first direction at second angle, wherein the first direction is from the first end towards the second end of the vane, and wherein the side edges define a width smaller than a predetermined distance between first and second mounting elements of the throwing wheel apparatus so that when coupled to the mounting elements a gap is present on both sides of the vane.

2. The vane of claim 1, wherein the locking member protrudes out from side edges of the vane.

3. The vane of claim 1, wherein the locking member comprises:

a front surface which is the first surface and two front side surfaces, the front side surfaces are disposed between the front surface and respective ones of the first throwing face and the second throwing face.

4. The vane of claim 3, wherein the front side surfaces are second surfaces tapered at the second angle.

5. A mounting assembly of a throwing wheel apparatus, the mounting assembly comprising:

a first mounting element; and a second mounting element, wherein the first and second mounting elements are adapted to be arranged substantially parallel to one another and spaced apart from one another along a central axis of rotation, and wherein each of the first and second mounting elements define a mounting face having a central bore and a plurality of radially extending mounting recesses, each mounting recess adapted to detachably receive a locking member of a vane, wherein each mounting recess is tapered in two mounting planes, including a first taper in a first plane and a second taper in a second plane, wherein the first plane is substantially parallel to the central axis of rotation and the second plane is substantially perpendicular to the first taper.

6. A throwing wheel apparatus, comprising:

a vane comprising a first end, a second end, and a particle throwing portion extending between the first and second ends and including a first throwing face, a second throwing face, and two side edges, wherein each of the side edges extend substantially parallel to one another and include a locking member adapted to be detachably coupled to a mounting element of the throwing wheel apparatus, wherein each locking member includes a first surface extending from the first end towards the second end, the first surface being tapered along a first direction and a second surface extending from the first end towards the second end, the second surface being tapered along the first direction, and wherein the first direction is from the first end of the vane towards the second end of the vane; and a mounting assembly comprising a first mounting element and a second mounting element, wherein the first and second mounting elements are adapted to be arranged substantially parallel to one another and spaced apart from one another along a central axis of rotation, and wherein each of the first and second mounting elements define a mounting face having a central bore and a plurality of radially extending mounting recesses, each mounting recess adapted to detachably receive a locking member of the vane, wherein each mounting recess is tapered in two mounting planes corresponding to the first and second planes of the locking portion of the vane, and wherein the side edges of the vane define a width smaller than a predetermined distance between the first and second mounting elements of the mounting assembly so that when coupled to the mounting elements a gap is present on both sides of the vane.

7. The throwing wheel apparatus of claim 6, wherein the locking members protrude out from side edges of the vane towards the first and second mounting elements, respectively.

8. The throwing wheel apparatus of claim 6, wherein the locking member comprises:

a front surface which is the first surface and two front side surfaces, the front side surfaces are disposed between the front surface and respective ones of the first throwing face and the second throwing face.

9. The throwing wheel apparatus of claim 8, wherein the front side surfaces are second surfaces.

10. A vane of a throwing wheel apparatus, comprising:

a first end;

a second end; and a particle throwing portion extending between the first and second ends and including a first throwing face, a second throwing face, and two side edges, wherein each of the side edges extend substantially parallel to one another and includes a locking member adapted to be detachably coupled to a mounting element of the throwing wheel apparatus, wherein each locking member includes a front surface having side edges opposite each other and two front side surfaces, the front side surfaces are disposed between a respective side edge of the front surface and respective ones of the first throwing face and the second throwing face, the front surface is tapered along a first direction at a first angle and the front side surfaces are tapered along the first direction at second angle, wherein the first direction is from the first end towards the second end of the vane, and wherein the side edges define a width smaller than a predetermined distance between first and second mounting elements of the throwing wheel apparatus so that when coupled to the mounting elements a gap is present on both sides of the vane.

11. The vane of claim 1, wherein the front surfaces are in first planes substantially parallel to each side edge of the vane and the front side surfaces are in second planes substantially perpendicular to the first planes.

* * * * *